US008415867B2

(12) United States Patent
Tanaka et al.

(10) Patent No.: US 8,415,867 B2
(45) Date of Patent: Apr. 9, 2013

(54) SPARK PLUG

(75) Inventors: Tomoo Tanaka, Kitanagoya (JP); Daisuke Sumoyama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/145,954

(22) PCT Filed: Jan. 21, 2010

(86) PCT No.: PCT/JP2010/000327
§ 371 (c)(1),
(2), (4) Date: Jul. 22, 2011

(87) PCT Pub. No.: WO2010/084755
PCT Pub. Date: Jul. 29, 2010

(65) Prior Publication Data

US 2011/0285270 A1 Nov. 24, 2011

(30) Foreign Application Priority Data

Jan. 23, 2009 (JP) ..... 2009-013088

(51) Int. Cl.
*H01T 13/20* (2006.01)

(52) U.S. Cl. ..... 313/141; 313/118; 313/143

(58) Field of Classification Search ..... 313/118, 313/141–145
See application file for complete search history.

(56) References Cited

U.S. PATENT DOCUMENTS

| | | | | |
|---|---|---|---|---|
| 4,400,643 | A * | 8/1983 | Nishio et al. | 313/11.5 |
| 4,427,915 | A * | 1/1984 | Nishio et al. | 313/141 |
| 2002/0017847 | A1 | 2/2002 | Kato et al. | |
| 2002/0130602 | A1 * | 9/2002 | Kanao et al. | 313/141 |
| 2003/0155849 | A1 * | 8/2003 | Hori | 313/141 |
| 2007/0236125 | A1 * | 10/2007 | Lykowski et al. | 313/141 |
| 2008/0018217 | A1 | 1/2008 | Boehler et al. | |
| 2008/0030116 | A1 * | 2/2008 | Joseph et al. | 313/141 |
| 2008/0036353 | A1 * | 2/2008 | Zdeblick et al. | 313/141 |
| 2008/0295925 | A1 | 12/2008 | Manhardt et al. | |
| 2009/0284117 | A1 * | 11/2009 | Lykowski | 313/141 |
| 2010/0253204 | A1 | 10/2010 | Boehler et al. | |

FOREIGN PATENT DOCUMENTS

| | | | |
|---|---|---|---|
| JP | 61-156683 | A | 7/1986 |
| JP | 5-047954 | B | 7/1993 |
| JP | 10-022053 | A | 1/1998 |
| JP | 2002-083663 | A | 3/2002 |
| JP | 2006-316344 | A | 11/2006 |
| WO | 2007/019990 | A1 | 2/2007 |
| WO | 2008/014192 | A1 | 1/2008 |

* cited by examiner

*Primary Examiner* — Anh T. Mai
*Assistant Examiner* — Kevin Quarterman
(74) *Attorney, Agent, or Firm* — Sughrue Mion, PLLC

(57) ABSTRACT

A spark plug 100 has a center electrode tip 90, 95 at an end portion of an electrode. The electrode tip 90, 95 contains Pd as a main component in an amount greater than 40% by weight and contains at least one element of Ir, Ni, Co, and Fe such that Ir, if contained, is contained in an amount of 0.5% by weight to 20% by weight inclusive and at least one element of Ni, Co, and Fe, if contained, is contained in an amount of 0.5% by weight to 40% by weight inclusive on an element basis.

6 Claims, 5 Drawing Sheets

FIG. 4

| | No. | Composition (wt.%) | | | | | | | Electrode erosion (mm) | Separation or cracking | Comprehensive judgment |
|---|---|---|---|---|---|---|---|---|---|---|---|
| | | Pd | Ir | Ni | Co | Fe | Rare earth etc. | Unavoidable impurities | | | |
| Example | 1 | 99 | 1 | | | 0.5 | | B,Na,Al,Si,Ba,etc. 0.01 | 0.15 | Fine cracking in restraint of grain growth | Good |
| Example | 2 | 98.4 | 1 | | | 0.5 | | B,Na,Al,Si,Ba,etc. 0.1 | 0.15 | Fine cracking in restraint of grain growth | Good |
| Example | 3 | 94.9 | 5 | | | | | B,Na,Al,Si,Ba,etc. 0.1 | 0.14 | None | Good |
| Example | 4 | 87.9 | 12 | | | | | B,Na,Al,Si,Ba,etc. 0.1 | 0.13 | None | Excellent |
| Example | 5 | 87.7 | 12 | | | | Ti 0.2 | B,Na,Al,Si,Ba,etc. 0.1 | 0.12 | None | Excellent |
| Example | 6 | 83.9 | 16 | | | | | B,Na,Al,Si,Ba,etc. 0.1 | 0.13 | None | Excellent |
| Example | 7 | 79.9 | 20 | | | | | B,Na,Al,Si,Ba,etc. 0.1 | 0.14 | None | Good |
| Example | 8 | 99.4 | | 0.5 | | | | B,Na,Al,Si,Ba,etc. 0.1 | 0.15 | Fin cracking in restraint of grain growth | Good |
| Example | 9 | 99.4 | | | 0.5 | | | B,Na,Al,Si,Ba,etc. 0.1 | 0.15 | Fine cracking in restraint of grain growth | Good |
| Example | 10 | 96.9 | | 3 | | | | B,Na,Al,Si,Ba,etc. 0.1 | 0.14 | None | Good |
| Example | 11 | 94.9 | | | | 5 | | B,Na,Al,Si,Ba,etc. 0.1 | 0.13 | None | Excellent |
| Example | 12 | 90.9 | | | 9 | | | B,Na,Al,Si,Ba,etc. 0.1 | 0.12 | None | Excellent |
| Example | 13 | 84.9 | | 15 | | | | B,Na,Al,Si,Ba,etc. 0.1 | 0.10 | None | Excellent |
| Example | 14 | 82.7 | | | 17 | | Ti 0.2 | B,Na,Al,Si,Ba,etc. 0.1 | 0.09 | None | Excellent |
| Example | 15 | 79.9 | | | | 20 | | B,Na,Al,Si,Ba,etc. 0.1 | 0.10 | None | Excellent |
| Example | 16 | 74.9 | | | 25 | | | B,Na,Al,Si,Ba,etc. 0.1 | 0.12 | None | Excellent |
| Example | 17 | 69.7 | | | | 30 | Hf 0.2 | B,Na,Al,Si,Ba,etc. 0.1 | 0.12 | None | Excellent |
| Example | 18 | 64.9 | | 35 | | | | B,Na,Al,Si,Ba,etc. 0.1 | 0.13 | None | Excellent |
| Example | 19 | 59.9 | | | | 40 | | B,Na,Al,Si,Ba,etc. 0.1 | 0.14 | Fine separation | Good |
| Example | 20 | 71.9 | 12 | 16 | | | | B,Na,Al,Si,Ba,etc. 0.1 | 0.13 | None | Excellent |
| Example | 21 | 51.9 | | 16 | 16 | 16 | | B,Na,Al,Si,Ba,etc. 0.1 | 0.14 | None | Good |
| Example | 22 | 40.9 | 12 | 16 | 16 | 15 | | B,Na,Al,Si,Ba,etc. 0.1 | 0.15 | None | Good |
| Example | 23 | 71.9 | 12 | 16 | | | Hf 0.05 | B,Na,Al,Si,Ba,etc. 0.1 | 0.12 | None | Excellent |
| Example | 24 | 71.7 | 12 | | 16 | | Y 0.2 | B,Na,Al,Si,Ba,etc. 0.1 | 0.11 | None | Excellent |
| Example | 25 | 71.4 | 12 | | | 16 | Zr 0.5 | B,Na,Al,Si,Ba,etc. 0.1 | 0.12 | None | Excellent |
| Example | 26 | 71.3 | 12 | | | 16 | Y 0.6 | B,Na,Al,Si,Ba,etc. 0.1 | 0.12 | Minor cracking | Fair |
| Example | 27 | 93.8 | | | 6 | | | B,Na,Al,Si,Ba,etc. 0.2 | 0.13 | None | Excellent |
| Example | 28 | 93.8 | | | 6 | | | B,Na,Al,Si,Ba,etc. 0.25 | 0.14 | Fine cracking in restraint of grain growth | Good |

FIG. 5

| | No. | Composition (wt.%) | | | | | | | Electrode erosion (mm) | Separation or cracking | Comprehensive judgment |
|---|---|---|---|---|---|---|---|---|---|---|---|
| | | Pd | Ir | Ni | Co | Fe | Rare earth etc. | Unavoidable impurities | | | |
| Comparative Example | 1 | 99.8 | | 0.2 | | | | B,Na,Al,Si,Ba,etc. 0.01 | - | Separation (detachment) | Failure |
| Comparative Example | 2 | 99.6 | | | 0.2 | 0.2 | | B,Na,Al,Si,Ba,etc. 0.01 | 0.20 | Large grain growth: large cracking and large separation | Failure |
| Comparative Example | 3 | 99.7 | | 0.3 | | | | B,Na,Al,Si,Ba,etc. 0.01 | - | Separation (detachment) | Failure |
| Comparative Example | 4 | 99.3 | | | 0.4 | 0.3 | | B,Na,Al,Si,Ba,etc. 0.01 | 0.16 | Large grain growth: large cracking and large separation | Failure |
| Comparative Example | 5 | 78.9 | 21 | | | | | B,Na,Al,Si,Ba,etc. 0.1 | 0.15 | Large cracking | Failure |
| Comparative Example | 6 | 57.9 | | 42 | | | | B,Na,Al,Si,Ba,etc. 0.1 | 0.16 | Minor separation (but large erosion) | Failure |
| Comparative Example | 7 | 38.9 | 15 | 16 | 15 | 15 | | B,Na,Al,Si,Ba,etc. 0.1 | 0.16 | Minor separation (but large erosion) | Failure |

FIG. 6

| | No. | Composition (wt.%) | | | | | | Si content of electrode base metal (wt.%) | Perspiration | Cracking |
|---|---|---|---|---|---|---|---|---|---|---|
| | | Pd | Ir | Ni | Co | Fe | Dissolved oxygen | | | |
| Example | 29 | 88 | 12 | | | | 100 ppm | 0.5 | Excellent | Excellent |
| Example | 30 | 88 | 12 | | | | 310 ppm | 0.5 | Fair | Excellent |
| Example | 31 | 88 | 12 | | | | 100 ppm | 3.2 | Excellent | Fair |
| Example | 32 | 85 | | 15 | | | 280 ppm | 1.0 | Excellent | Excellent |
| Example | 33 | 85 | | 15 | | | 315 ppm | 1.0 | Fair | Excellent |
| Example | 34 | 85 | | 15 | | | 280 ppm | 3.5 | Excellent | Fair |
| Example | 35 | 85 | | | 15 | | 70 ppm | 3.0 | Excellent | Excellent |
| Example | 36 | 85 | | | 15 | | 390 ppm | 3.0 | Fair | Excellent |
| Example | 37 | 85 | | | 15 | | 70 ppm | 3.2 | Excellent | Fair |
| Example | 38 | 95 | | | | 5 | 200 ppm | 2.0 | Excellent | Excellent |
| Example | 39 | 95 | | | | 5 | 305 ppm | 2.0 | Fair | Excellent |
| Example | 40 | 85 | | | | 15 | 200 ppm | 3.5 | Excellent | Fair |

SPARK PLUG

TECHNICAL FIELD

The present invention relates to the composition of an electrode tip provided at an end of an electrode of a spark plug.

BACKGROUND ART

Conventionally, platinum (Pt) is in practical use as material for an electrode tip provided at an end of an electrode of a spark plug. Also, use of palladium (Pd) as an alternative material to Pt, which is a rare metal, is proposed for forming an electrode tip (refer to, for example, Patent Document 1).

PRIOR ART DOCUMENT

Patent Document

Patent Document 1: Japanese Patent Publication (kokoku) No. H05-47954
Patent Document 2: Japanese Patent Application Laid-Open (kokai) No. H10-22053
Patent Document 3: Japanese Patent Application Laid-Open (kokai) No. 2002-83663
Patent Document 4: WO2008/014192

However, since Pd is lower in melting point than Pt, Pd is inferior to Pt in resistance to spark-induced erosion. Also, Pd is apt to undergo grain growth at high combustion chamber temperature, thereby causing separation or cracking of a tip. Therefore, use of Pd involves a problem of low reliability.

SUMMARY OF THE INVENTION

Problems to be Solved by the Invention

The present invention has been conceived to solve the conventional problem mentioned above, and an object of the invention is to improve reliability and resistance to spark-induced erosion of an electrode tip formed through use of Pd.

Means for Solving the Problems

The present invention has been conceived to solve, at least partially, the above problem and can be embodied in the following modes or application examples.

Application Example 1

A spark plug having an electrode tip at an end portion of an electrode, the electrode tip containing Pd as a main component in an amount greater than 40% by weight and containing at least one element of iridium (Ir), nickel (Ni), cobalt (Co), and iron (Fe) such that Ir, if contained, is contained in an amount of 0.5% by weight to 20% by weight inclusive and at least one element of Ni, Co, and Fe, if contained, is contained in an amount of 0.5% by weight to 40% by weight inclusive on an element basis.

The spark plug of application example 1 can have characteristics such that, while a material which contains Pd is used to form the electrode tip, the electrode tip exhibits excellent resistance to spark-induced erosion and is unlikely to suffer separation and cracking.

Application Example 2

A spark plug according to application example 1, wherein the electrode tip contains any element of titanium (Ti), zirconium (Zr), hafnium (Hf), and rare earth elements in an amount of 0.05% by weight to 0.5% by weight inclusive.

Through employment of the composition, the spark plug can have characteristics such that the electrode tip exhibits quite excellent resistance to spark-induced erosion and is less likely to suffer separation and cracking.

Application Example 3

A spark plug according to application example 1 or 2, wherein the electrode tip contains an element other than Pd, Ir, Ni, Co, Fe, Ti, Zr, Hf, and rare earth elements in an amount of 0% by weight to 0.2% by weight inclusive.

Through employment of the composition, the spark plug can have characteristics such that the electrode tip exhibits quite excellent resistance to spark-induced erosion and is less likely to suffer separation and cracking.

Application Example 4

A spark plug according to any one of application examples 1 to 3, wherein the electrode tip contains residual oxygen in an amount of 0 ppm to 300 ppm inclusive.

Through employment of the composition, the spark plug can have characteristics such that perspiration of the electrode tip and a short circuit between electrodes are less likely to occur.

Application Example 5

A spark plug according any one of application examples 1 to 4, wherein the electrode is made of Ni, or an alloy which contains Ni as a main component, and contains silicon (Si) in an amount of 3% by weight or less.

Through employment of the composition, the spark plug can have characteristics such that perspiration of the electrode tip is unlikely to occur.

The present invention can be embodied in various forms. For example, the present invention can be embodied in a method of manufacturing a spark plug, a method of manufacturing an electrode tip provided on an electrode of a spark plug, and an electrode tip material for a spark plug.

BRIEF DESCRIPTION OF THE DRAWINGS

FIG. 4 Table showing the compositions and the results of evaluation of the electrode tip members used in Examples 1 to 28.

FIG. 5 Table showing the compositions and the results of evaluation of the electrode tip members used in Comparative Examples 1 to 7.

FIG. 6 Table showing the compositions and the results of evaluation of the electrode tip members used in Examples 29 to 40.

MODES FOR CARRYING OUT THE INVENTION

An embodiment and examples of a spark plug according to a mode for carrying out the present invention will next be described in the following order.

A. Embodiment
B. Examples
C. Modifications of Embodiment

A. Embodiment

Structure of Spark Plug

Figure 1:
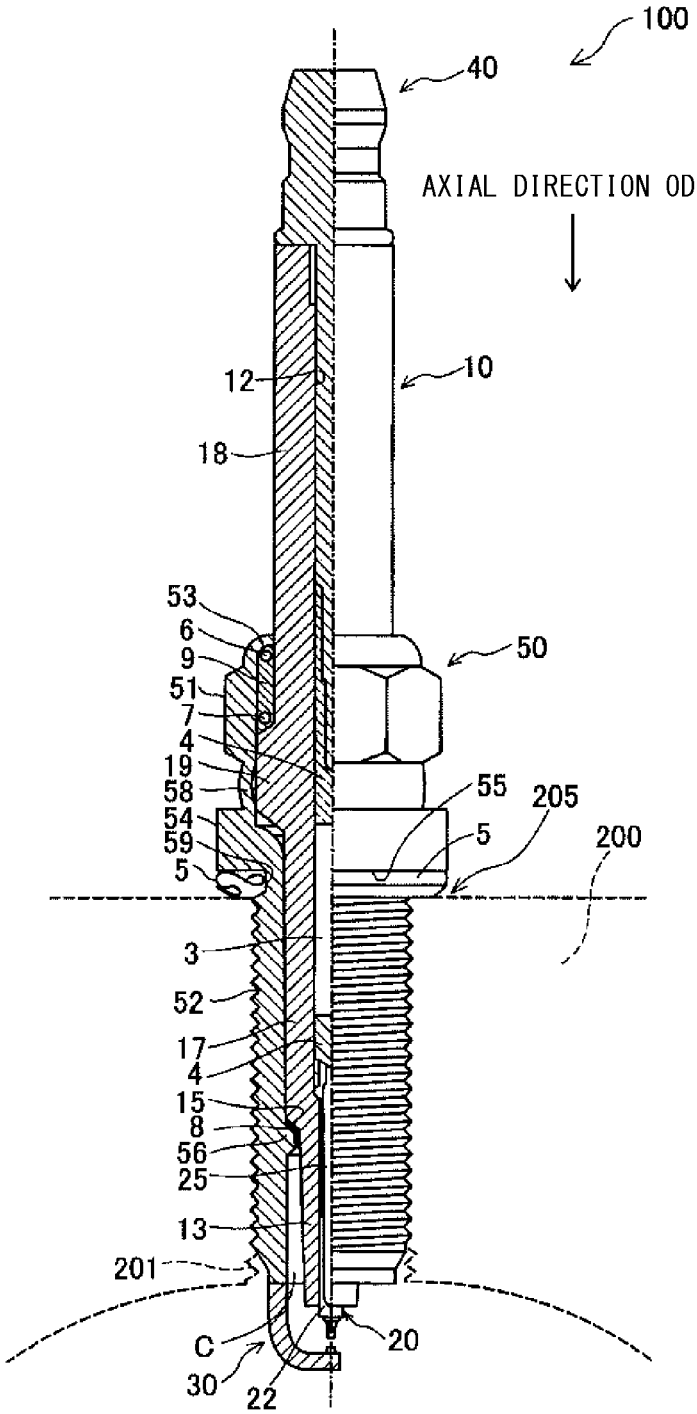
FIG. 1 Partially sectional view showing a spark plug according to an embodiment of the present invention.

FIG. 1 is a partially sectional view showing a spark plug 100 according to an embodiment of the present invention. In the following description, an axial direction OD of the spark plug 100 in FIG. 1 is referred to as the vertical direction, and the lower side of the spark plug 100 in FIG. 1 is referred to as the front side of the spark plug 100, and the upper side as the rear side.

The spark plug 100 includes a ceramic insulator 10, a metallic shell 50, a center electrode 20, a ground electrode 30, and a metal terminal 40. The center electrode 20 is held while extending in the ceramic insulator 10 in the axial direction OD. The ceramic insulator 10 functions as an insulator. The metallic shell 50 holds the ceramic insulator 10. The metal terminal 40 is provided at a rear end portion of the ceramic insulator 10. The constitution of the center electrode 20 and the ground electrode 30 will be described in detail later with reference to FIG. 2.

The ceramic insulator 10 is formed from alumina, etc. through firing and has a tubular shape such that an axial hole 12 extends therethrough coaxially along the axial direction OD. The ceramic insulator 10 has a flange portion 19 having the largest outside diameter and located substantially at the center with respect to the axial direction OD and a rear trunk portion 18 located rearward (upward in FIG. 1) of the flange portion 19. The ceramic insulator 10 also has a front trunk portion 17 smaller in outside diameter than the rear trunk portion 18 and located frontward (downward in FIG. 1) of the flange portion 19, and a leg portion 13 smaller in outside diameter than the front trunk portion 17 and located frontward of the front trunk portion 17. The leg portion 13 is reduced in diameter in the frontward direction and is exposed to a combustion chamber of an internal combustion engine when the spark plug 100 is mounted to an engine head 200 of the engine. A stepped portion 15 is formed between the leg portion 13 and the front trunk portion 17.

The metallic shell 50 is a cylindrical metallic member formed of low-carbon steel and is adapted to fix the spark plug 100 to the engine head 200 of the internal combustion engine. The metallic shell 50 holds the ceramic insulator 10 therein while surrounding a region of the ceramic insulator 10 extending from a portion of the rear trunk portion 18 to the leg portion 13.

The metallic shell 50 has a tool engagement portion 51 and a mounting threaded portion 52. The tool engagement portion 51 allows a spark plug wrench (not shown) to be fitted thereto. The mounting threaded portion 52 of the metallic shell 50 has threads formed thereon and is threadingly engaged with a mounting threaded hole 201 of the engine head 200 provided at an upper portion of the internal combustion engine.

The metallic shell 50 has a flange-like seal portion 54 formed between the tool engagement portion 51 and the mounting threaded portion 52. An annular gasket 5 formed by folding a sheet is fitted to a screw neck 59 between the mounting threaded portion 52 and the seal portion 54. When the spark plug 100 is mounted to the engine head 200, the gasket 5 is crushed and deformed between a seat surface 55 of the seal portion 54 and a peripheral surface 205 around the opening of the mounting threaded hole 201. The deformation of the gasket 5 provides a seal between the spark plug 100 and the engine head 200, thereby ensuring gastightness within an engine via the mounting threaded hole 201.

The metallic shell 50 has a thin-walled crimp portion 53 located rearward of the tool engagement portion 51. The metallic shell 50 also has a buckle portion 58, which is thin-walled similar to the crimp portion 53, between the seal portion 54 and the tool engagement portion 51. Annular ring members 6, 7 intervene between an outer circumferential surface of the rear trunk portion 18 of the ceramic insulator 10 and an inner circumferential surface of the metallic shell 50 extending from the tool engagement portion 51 to the crimp portion 53. Further, a space between the two ring members 6, 7 is filled with powder of talc 9. When the crimp portion 53 is crimped inward, the ceramic insulator 10 is pressed frontward within the metallic shell 50 via the ring members 6, 7 and the talc 9. Accordingly, the stepped portion 15 of the ceramic insulator 10 is supported by a stepped portion 56 formed on the inner circumference of the metallic shell 50, whereby the metallic shell 50 and the ceramic insulator 10 are united together. At this time, gastightness between the metallic shell 50 and the ceramic insulator 10 is maintained by means of an annular sheet packing 8 which intervenes between the stepped portion 15 of the ceramic insulator 10 and the stepped portion 56 of the metallic shell 50, thereby preventing outflow of combustion gas. The buckle portion 58 is designed to be deformed outwardly in association with application of compressive force in a crimping process, thereby contributing toward increasing the stroke of compression of the talc 9 and thus enhancing gastightness within the metallic shell 50. A clearance C having a predetermined dimension is provided between the ceramic insulator 10 and a portion of the metallic shell 50 located frontward of the stepped portion 56.

Figure 2:
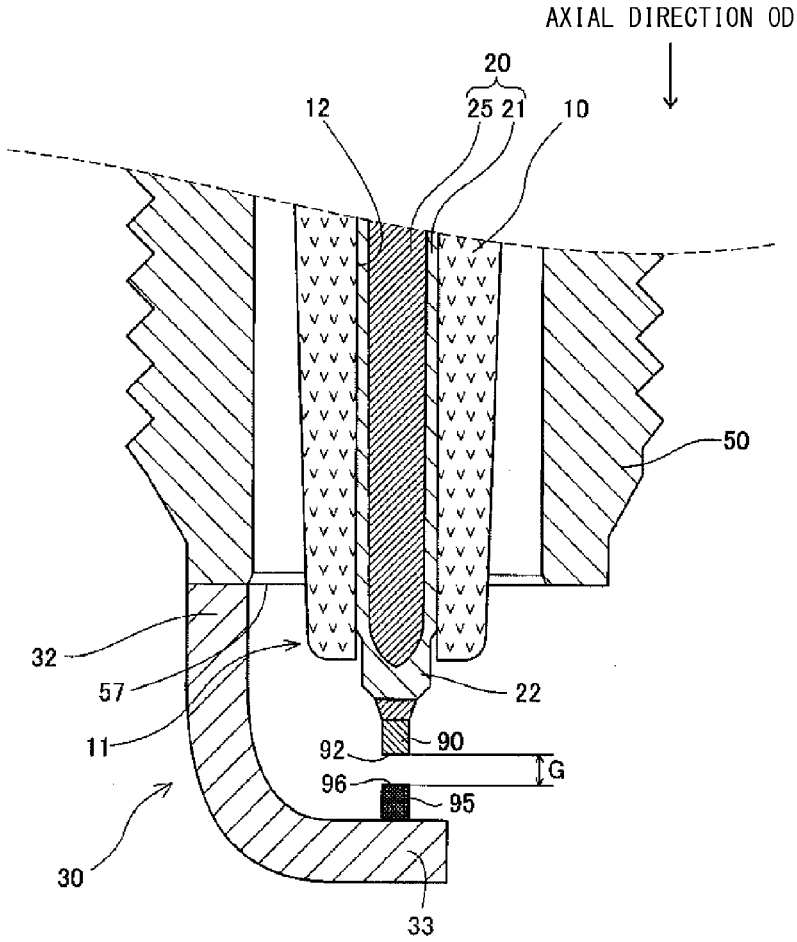
FIG. 2 Enlarged view showing the periphery of a front end portion of a center electrode of the spark plug.

FIG. 2 is an enlarged view showing the periphery of a front end portion 22 of the center electrode 20 of the spark plug 100. The center electrode 20 is a rodlike electrode having a structure in which a core 25 is embedded within an electrode base metal 21. The electrode base metal 21 is formed of nickel (Ni) or an alloy which contains Ni as a main component, such as INCONEL (trade name) 600 or 601. The core 25 is formed of copper (Cu) or an ally which contains Cu as a main component, copper and the alloy being superior in thermal conductivity to the electrode base metal 21. Usually, the center electrode 20 is fabricated as follows: the core 25 is displaced within the electrode base metal 21 which is formed into a closed-bottomed tubular shape, and the resultant assembly is drawn by extrusion from the bottom side. The core 25 is formed such that, while its trunk portion has a substantially constant outside diameter, its front end portion is tapered. The center electrode 20 extends rearward through the axial hole 12 and is electrically connected to the metal terminal 40 (FIG. 1) via a seal body 4 and a ceramic resistor 3 (FIG. 1). A high-voltage cable (not shown) is connected to the metal terminal 40 (FIG. 1) via a plug cap (not shown) for applying high voltage to the metal terminal 40.

The front end portion 22 of the center electrode 20 projects from a front end portion 11 of the ceramic insulator 10. A center electrode tip 90 is joined to the front end surface of the front end portion 22 of the center electrode 20. The center electrode tip 90 has a substantially circular columnar shape extending in the axial direction OD. The specific composition of the center electrode tip 90 will be described later.

The ground electrode 30 is formed of a metal having high corrosion resistance; for example, an Ni alloy, such as INCONEL (trade name) 600 or 601. A proximal end portion 32 of the ground electrode 30 is joined to a front end surface 57 of the metallic shell 50 by welding. Also, the ground electrode 30 is bent such that a distal end portion 33 thereof faces an end surface 92 of the center electrode tip 90.

Further, a ground electrode tip 95 is joined to the distal end portion 33 of the ground electrode 30. An end surface 96 of the ground electrode tip 95 faces the end surface 92 of the center electrode tip 90. The ground electrode tip 95 can be formed of material similar to that used to form the center electrode tip 90. In the description below, the center electrode 20 and the ground electrode 30 may be collectively called "the electrode 20, 30," and the center electrode tip 90 and the ground electrode tip 95 may be collectively called "the electrode tip 90, 95." A spark discharge gap G (mm), where sparks are generated, is formed between the center electrode tip 90 and the ground electrode tip 95.

Compositions of Electrode Tip Material and Base Metal Material

Figure 3:
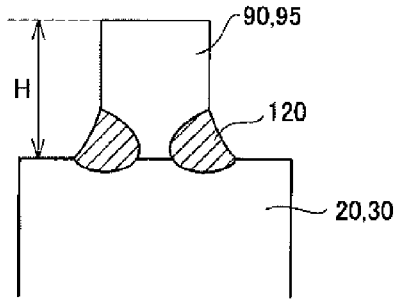
FIG. 3 Sectional view showing, on an enlarged scale, a joint portion between an electrode tip and an electrode.

FIG. 3 is a sectional view showing, on an enlarged scale, a joint portion between the electrode tip 90, 95 and the electrode 20, 30. FIG. 3 shows an example of welding the electrode tip 90, 95 directly to the electrode 20, 30. The electrode tip 90, 95 is formed of an alloy which contains Pd as a main component; i.e., an alloy which contains Pd predominantly in terms of % by weight.

Also, the electrode tip 90, 95 and the electrode 20, 30 are joined together by, for example, laser welding. In FIG. 3, a laser fusion portion 120 is formed. Since the laser fusion portion 120 is formed in welding the center electrode tip 90, 95 to the electrode 20, 30, the laser fusion portion 120 contains metal components of both the center electrode tip 90, 95 and the electrode 20, 30. The electrode tip 90, 95 and the center electrode 20, 30 may be joined together by resistance welding.

Preferably, the material (electrode tip material) of the electrode tip 90, 95 contains Pd in an amount greater than 40% by weight. Since Pd is less expensive than Pt, an electrode which contains Pd in a greater amount is desired.

Preferably, the electrode tip material further contains iridium (Ir) in an amount of 0.5% by weight to 20% by weight inclusive. Addition of Ir raises the melting point of the electrode tip material, thereby enhancing resistance to spark-induced erosion. This is for the following reason: an increase in melting point lowers the sputtering yield of the electrode tip material and restrains grain growth associated with an increase in temperature within an internal combustion engine in operation. An electrode tip material higher in melting point is known to exhibit higher resistance to spark-induced erosion. The sputtering yield is the number of atoms of a sample solid ejected by sputtering when a single ion impinges on the surface of the solid. The electrode tip material lower in sputtering yield is known to exhibit higher resistance to spark-induced erosion. Grain growth generates cracking in grain boundaries. When the electrode material is large in the degree of grain growth in operation of an internal combustion engine, the electrode material is known to suffer separation or cracking.

Since Ir and Pd are in the form of a complete solid solution, the melting point increases with the amount of addition of Ir, and thus the effect of lowering the sputtering yield improves as the amount of addition of Ir increases; preferably, the amount of addition of Ir is 0.5% by weight or greater. However, although Ir and Pd are in the form of a complete solid solution, spinodal decomposition arises, for example, as follows: at a Pd content of 37% by weight and at a temperature of 1,482° C. or lower, a two-phase region consisting of an Ir solid solution and a Pd solid solution exists. As a result, in microscopic view, a region different from a desired composition exists, resulting in difficulty in yielding the above-mentioned effect. Separation of the two phases embrittles the electrode tip material; consequently, cracking or separation is likely to occur from repeated heating/cooling cycles in operation of the internal combustion engine. Also, the electrode tip material in which separation of the two phases has occurred deteriorates in workability, potentially resulting in significant deterioration in productivity. In view of these, preferably, the amount of addition of Ir is 20% by weight or less. Also, from experimental results, more preferably, the amount of addition of Ir is 5% by weight or greater and, further preferably, 12% by weight or greater; much more preferably, the amount of addition of Ir is 16% by weight or less.

Preferably, the electrode tip material contains, in addition to or in place of Ir, at least one of nickel (Ni), cobalt (Co), and iron (Fe) in an amount of 0.5% by weight to 40% by weight inclusive on an element basis, more preferably 5% by weight to 35% by weight inclusive on an element basis. Since Ni, Co, and Fe are low in sputtering yield, resistance to spark-induced erosion of the electrode tip material can be enhanced. Also, the electrode tip 90, 95 of the present embodiment is joined to the electrode 20, 30 made of Ni or an alloy which contains Ni as a main component. The difference in thermal expansion coefficient between Pd and Ni is about 3 ppm (parts per million)/° C. at room temperature. Since addition of Ni, Co, or Fe to the electrode tip material reduces the difference in thermal expansion coefficient between the electrode tip 90, 95 and the electrode 20, 30, joining between the electrode tip 90, 95 and the electrode 20, 30 is improved. As a result, the spark plug 100 can be improved in resistance to thermal cycle (resistance to separation). Meanwhile, when Ni, Co, or Fe is added in an amount greater than 40% by weight, the melting point of the electrode tip material drops significantly. Also, when Ni, Co, or Fe is added in an amount greater than 40% by weight, oxidation of Ni, Co, or Fe arises. Thus, when Ni, Co, or Fe is added in an amount greater than 40% by weight, resistance to spark-induced erosion deteriorates. The temperature of the electrode tip material within the internal combustion engine reaches near 1,000° C. Thus, in additional consideration of spark energy, preferably, the melting point of the electrode tip material is 1,100° C. or higher. The electrode tip material having a melting point equal to or lower than 1,100° C. is conceived to fail to exhibit required resistance to spark-induced erosion.

Use of pure Pd as the electrode tip material involves the following problem: in operation of an internal combustion engine, thermal stress induced by the above-mentioned difference in thermal expansion coefficient causes separation or cracking. In connection with cracking, embrittlement of material (deterioration of grain-boundary strength caused by grain growth, and hydrogen embrittlement) accelerates the effect of thermal stress. Grain growth can be restrained through addition of the above-mentioned element Ir, Ni, Co, or Fe. In order to effectively restrain grain growth, preferably, the amount of addition of each of these elements is 0.5% by weight or greater. Generally, the element Pd has high hydrogen permeability. In an atmosphere within an operating internal combustion engine, hydrogen is generated through thermal decomposition of water and fuel. Generated hydrogen diffuses in Pd, thereby causing embrittlement. For restraining this problem, adding the above-mentioned element Ir, Ni, Co, or Fe in an amount of 0.5% by weight or greater is effective.

The electrode tip material may contain a plurality of elements among Ir, Ni, Co, and Fe; however, preferably, the total amount thereof does not exceed 60% by weight. This is for the following reason: as mentioned above, a preferred amount of Pd is 40% by weight or greater.

Preferably, the electrode tip material further contains titanium (Ti), zirconium (Zr), hafnium (Hf), or a rare earth element in an amount of 0.05% by weight to 0.5% by weight inclusive, more preferably 0.2% by weight to 0.5% by weight inclusive. Preferred rare earth elements are scandium (Sc), yttrium (Y), lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Y and Nd are particularly preferred.

Adding Ti, Zr, Hf, or a rare earth element to the electrode tip material can restrain grain growth during operation of an internal combustion engine. As a result, resistance to thermal cycle of the electrode tip 90, 95 is improved. A content of Ti, Zr, Hf, or a rare earth element of less than 0.05% by weight is less effective. When the content of Ti, Zr, Hf, or a rare earth element is in excess of 0.5% by weight, oxide is likely to be generated in the interface of joining between the electrode tip 90, 95 and the electrode 20, 30, which is formed of Ni or an alloy which contains Ni as a main component, and in grain boundaries. Such oxide may deteriorate durability of the electrode tip 90, 95. Ti, Zr, Hf, or a rare earth element may be added in the form of an element or oxide. Even in the case of addition in the form of an oxide, a content less than 0.05% by weight is less effective; and, a content in excess of 0.5% by weight lowers welding strength through oxide aggregating in the interface of joining between the electrode tip 90, 95 and the electrode 20, 30, which is formed of Ni or an alloy which contains Ni as a main component, potentially resulting in significant deterioration in workability.

Further, in the course of manufacture, preferably, the amount of unavoidable impurities contained in the electrode tip material is 0.2% by weight or less. Unavoidable impurities are substances which remain in the final electrode tip material without intentional addition in the course of manufacture; i.e., as a result of existence in raw materials or incidentally getting mixed in during the course of manufacture. Examples of unavoidable impurities include boron (B), sodium (Na), aluminum (Al), silicon (Si), barium (Ba), and oxygen (O).

At the time of operation of an internal combustion engine, unavoidable impurities aggregate in grain boundaries of the electrode tip material and capture oxygen, thereby accelerating oxidation-induced consumption. Further, unavoidable impurities bring about intergranular oxidation, potentially causing intergranular cracking. Thus, preferably, unavoidable impurities are contained in an amount of 0.2% by weight or less.

Preferably, oxygen which the electrode tip material contains as unavoidable impurity in the course of manufacture is in an amount of 300 ppm (parts per million) or less. Through the concentration of dissolved oxygen in the electrode tip material being 300 ppm or less, so-called perspiration can be restrained. Perspiration is a phenomenon that, when an internal combustion engine is in operation, the electrode tip material partially melts. Perspiration may cause a short circuit between the center electrode tip 90 of the center electrode 20 and the ground electrode tip 95 of the ground electrode 30 or a like problem.

The mechanism of perspiration is conceived as follows. In an internal combustion engine, hydrogen is generated through decomposition of water generated in association with combustion or through thermal decomposition of fuel. Generated hydrogen diffuses within the electrode tip material. As compared with Pt, Pd is known to have very high hydrogen dissolubility and hydrogen permeability. In the case of the electrode tip material which contains Pd as a main component, water vapor may be generated within the electrode tip material through reaction between hydrogen and dissolved oxygen within Pd. Generation of water vapor causes expansion of the electrode tip material and oxidation within the electrode tip material, and water vapor undergoes dissociation into hydrogen and oxygen in a reducing condition. Repetition of such reaction causes the electrode tip material to assume a spongy structure; consequently, heat transfer deteriorates, resulting in perspiration through overheat and melting.

In order to restrain such generation of perspiration, preferably, the amount of dissolved oxygen is 300 ppm or less as mentioned above.

Next, the material (base metal material) of the center electrode 20 and the ground electrode 30, which collectively serve as base metal to which the electrode tip 90 and 95 is joined, respectively, will be described.

Preferably, the Si content of the base metal material is 3% by weight or less. As mentioned above, the base metal material is Ni or an alloy which contains Ni as a main component. However, in order to improve oxidation resistance, Al, Cr, and Si may be added to the base metal material. In a high-temperature environment established within an internal combustion engine in operation, these elements diffuse toward the electrode tip 90, 95. Among these added elements, Si undergoes eutectic reaction with Pd at relatively low temperature. Since Si has very small Pd solubility, diffusion of a small amount of Si initiates eutectic reaction. Eutectic temperature for Pd and Si is 821° C. Thus, a temperature of about 1,100° C. which the electrode tip 90, 95 may reach during operation of the internal combustion engine is higher than the eutectic temperature. Therefore, a liquid phase is generated partially in the electrode tip material. The generation of the liquid phase in the electrode tip material may cause a deterioration in resistance to spark-induced erosion, intergranular oxidation, cracking stemming from grain coarsening, and perspiration; thus, the durability of the electrode tip 90, 95 may be significantly damaged. In order to restrain the occurrence of these problems, preferably, the electrode tip material of the present embodiment is joined, for use, to the electrode base metal whose Si content is 3% by weight or less.

B. Examples

In order to verify the effects of the present embodiment, a plurality of spark plug samples were fabricated and subjected to an evaluation test. The evaluation test and criteria for evaluation will be described later. The plurality of samples differed in electrode tip material used to form the ground electrode tip 95 and in base metal material used to form the ground electrode 30.

The electrode tip material was manufactured by a melting process in which predetermined elements (Ir, Ni, Co, Fe, Ti, Hf, Zr, and Y) were added to Pd at predetermined ratios and the resultant mixture was melted. The electrode tip material was formed into a cylindrical ground electrode tip 95 having a diameter of 0.9 mm and a height of 0.6 mm. The amount of unavoidable impurities contained in the electrode tip material was measured by glow discharge mass spectrometry (GS-MS). The amount of dissolved oxygen contained in the electrode tip material was measured as follows: the electrode tip material was melted through application of heat in inert gas, and the molten material was analyzed by the non-dispersive infrared method (NDIR). The melting process was carried out by arc melting in an argon (Ar) atmosphere. By means of adjusting the oxygen content in the introduced Ar gas, the amount of dissolved oxygen contained in the electrode tip material was adjusted. The amount of unavoidable impurities was adjusted by means of adjusting the purity of added elements.

FIG. 4 is a table showing the compositions and the results of evaluation of the electrode tip members used in Examples 1 to 28. FIG. 5 is a table showing the compositions and the results of evaluation of the electrode tip members used in Comparative Examples 1 to 7. In Examples 1 to 28 and Comparative Examples 1 to 7, the amount of dissolved oxygen contained in the electrode tip material was adjusted to 200 ppm. In Examples 1 to 28 and Comparative Examples 1 to 7, the base metal material used to form the ground electrode 30 was a piece of INCONEL 601 (commercially available material having an Si content of 0.2% by weight) having a sectional size of 1.3 mm×2 mm.

The evaluation test on Examples 1 to 28 and Comparative Example 1 to 7 was conducted as follows. The samples were mounted to a six-cylinder engine (displacement 2,800 cc) and subjected to operation of the engine. An operation cycle consisting of one-minute operation at a rotational speed of 5,500 rpm with full throttle opening and subsequent one-minute idling was repeated for 300 hours. After the operation of the engine, the ground electrode tips 95 of the samples were evaluated for resistance to spark-induced erosion, separation, and cracking.

FIGS. 4 and 5 also show the comprehensive evaluation of the Examples and Comparative Examples in the right end columns. Criteria for comprehensive evaluation were as follows: "excellent" in the case where separation and cracking are not observed and the amount of electrode erosion is 0.13 mm (millimeter) or less; "good" in the case where fine cracking or separation is observed or the amount of electrode erosion is 0.14 mm to 0.15 mm; "fair" in the case where minor separation or cracking is observed and the amount of electrode erosion is 0.14 mm to 0.15 mm; and "failure" in the case where major separation or cracking is observed or the amount of electrode erosion is in excess of 0.15 mm. The degree of cracking, separation, and grain growth was examined by observing the surface and the section of the ground electrode tip 95 through a magnifier and a metallograph. The amount of electrode erosion is the difference in the thickness of the ground electrode tip 95 shown in FIG. 3 between the section of the ground electrode tip 95 before operation of the engine and the section of the ground electrode tip 95 after operation of the engine as measured by observation through the metallograph. Fine cracking or separation is such that, as observed on the section, the amount of penetration of cracking or the amount of separation is 0.1 mm or less; minor cracking or separation is such that, as observed on the section, the amount of penetration of cracking or the amount of separation is in excess of 0.1 mm and 0.2 mm or less; and major cracking or separation is such that, as observed on the section, the amount of penetration of cracking or the amount of separation is in excess of 0.2 mm.

As is apparent from the test results, use of the electrode tip material which contains Pd in an amount of 40% by weight or greater and Ir in an amount of 0.5% by weight to 20% by weight inclusive yields an electrode tip which exhibits excellent resistance to spark-induced erosion and is unlikely to suffer cracking and separation. Also, as shown by the test results, in the case of Ir being added in an amount of 12% by weight to 16% by weight inclusive, there is yielded an electrode tip which exhibits quite excellent resistance to spark-induced erosion and is unlikely to suffer cracking and separation.

Similarly, as shown by the test results, use of the electrode tip material which contains Pd in an amount of 40% by weight or greater and at least one of Ni, Co, and Fe in an amount of 0.5% by weight to 40% by weight inclusive on an element basis yields an electrode tip which exhibits excellent resistance to spark-induced erosion and is unlikely to suffer cracking and separation. Also, as shown by the test results, in the case where at least one of Ni, Co, and Fe is contained in an amount of 5% by weight to 35% by weight on an element basis, there is yielded an electrode tip which exhibits quite excellent resistance to spark-induced erosion and is unlikely to suffer cracking and separation.

Also, as shown by the test results, although the total amount of addition of a plurality of elements among Ir, Ni, Co, and Fe is in excess of 40% by weight, if each of the elements is added in an amount which falls within the above-mentioned range and Pd is contained in an amount of 40% by weight or greater, there is yielded an electrode tip which exhibits relatively excellent resistance to spark-induced erosion and is unlikely to suffer cracking and separation.

Further, as shown by the test results, by means of the electrode tip material containing one of Ti, Zr, Hf, Y, Nd, and Ce in an amount of 0.05% by weight to 0.5% by weight, there is yielded an electrode tip which exhibits quite excellent resistance to spark-induced erosion and is unlikely to suffer cracking and separation.

Further, as shown by the test results, by means of restraining the content of unavoidable impurities, such as B, Na, Al, Si, and Ba, in the electrode tip material to 0.2% by weight or less, there is yielded an electrode tip which exhibits excellent resistance to spark-induced erosion and is unlikely to suffer cracking and separation.

FIG. 6 is a table showing the compositions and the results of evaluation of the electrode tip members used in Examples 29 to 40. The evaluation test on Examples 29 to 40 is intended primarily to evaluate the influence on performance of the amount of dissolved oxygen contained in the electrode tip material and the influence on performance of the Si content of the base metal material used to form the ground electrode 30. Therefore, spark plug samples were fabricated in such a manner as to differ in the amount of dissolved oxygen contained in the electrode tip material used to form the ground electrode tip 95 and in the Si content of an Ni—Si alloy which served as the base metal material used to form the ground electrode 30.

Similar to the evaluation test on Examples 1 to 28 and Comparative Examples 1 to 7 mentioned above, the evaluation test on Examples 29 to 40 was conducted as follows. The samples were mounted to the six-cylinder engine (displacement 2,800 cc) and subjected to operation of the engine. An operation cycle consisting of one-minute operation at a rotational speed of 5,500 rpm with full throttle opening and subsequent one-minute idling was repeated for 300 hours. After the operation of the engine, the ground electrode tips 95 of the samples were evaluated for cracking and perspiration. Cracking was evaluated by the above-mentioned evaluation method, and perspiration was evaluated through visual observation of the surface of the electrode tip 95 by use of a magnifier. Criteria for evaluation regarding cracking were as follows: "excellent" in the case where no cracking exists; and "fair" in the case where minor cracking exists. Criteria for evaluation regarding perspiration were as follows: "excellent" in the case where no perspiration is observed; and "fair" in the case where some perspiration is observed.

As is apparent from the test results, the electrode tip material which contains Pd as a main component exhibits restraint of so-called perspiration if the concentration of dissolved oxygen is restrained to 300 ppm or less. Further, as shown by the test results, by means of material whose Si content is adjusted to 3.0% by weight or less being used to form the ground electrode 30, to which is connected the ground electrode tip 95 formed from the electrode tip material which contains Pd as a main component, cracking in the ground electrode tip 95 can be restrained.

In the Examples mentioned above, the ground electrode 30 and the ground electrode tip 95 were selected as subjects of evaluation for the following reason: the ground electrode 30 and the ground electrode tip 95, which are closer to the center of a combustion chamber of an internal combustion engine, are subjected to severer temperature and combustion conditions in the internal combustion engine than are the center electrode 20 and the center electrode tip 90. Therefore, as will be easily understood from the above evaluation results, when the electrode tip materials and base metal materials used in the above Examples are applied to the center electrode tip 90 and the center electrode 20, favorable results will be yielded.

C. Modifications of Embodiment

First Modification

The above embodiment is described while mentioning the longitudinal-discharge-type spark plug 100 in which the center electrode tip 90 and the ground electrode tip 95 face each other along the axial direction OD. However, the present invention is not limited thereto. For example, the present invention can be applied to a lateral-discharge-type spark plug in which the center electrode tip 90 and the ground electrode tip 95 face each other along a direction perpendicular to the axial direction OD. The positional relation between the ground electrode tip 95 and the center electrode tip 90 can be selected as appropriate according to application of the spark plug, required performance, etc. Also, a plurality of ground electrodes may be provided for a single center electrode.

Second Modification

The above-mentioned electrode tip material is used to form both the center electrode tip 90 and the ground electrode tip 95. However, the electrode tip material may be used to form only one of the center electrode tip 90 and the ground electrode tip 95. Also, the above-mentioned ground electrode tip 95 assumes the form of a flat tip, but may be formed into a substantially circular columnar shape extending in the axial direction OD.

While the present invention has been described with reference to the embodiment, the modifications of the embodiment, and the examples, the present invention is not limited to thereto, but may be embodied in various other forms without departing from the gist of the invention.

DESCRIPTION OF REFERENCE NUMERALS

3: ceramic resistor
4: seal body
5: gasket
6: ring member
8: sheet packing
9: talc
10: ceramic insulator
11: front end portion
12: axial hole
13: leg portion
15: stepped portion
17: front trunk portion
18: rear trunk portion
19: flange portion
20: center electrode
21: electrode base metal
22: front end portion
25: core
30: ground electrode
32: proximal end portion
33: distal end portion
40: metal terminal
50: metallic shell
51: tool engagement portion
52: mounting threaded portion
53: crimp portion
54: seal portion
55: seat surface
56: stepped portion
57: front end surface
58: buckle portion
59: screw neck
90, 95: electrode tip
100: spark plug
120: laser fusion portion
200: engine head
205: peripheral surface around opening

The invention claimed is:

1. A spark plug having an electrode tip at an end portion of an electrode, the electrode tip containing Pd as a main component in an amount greater than 40% by weight and containing at least one element selected from the group consisting of Ir, Ni, Co and Fe such that Ir, if contained, is contained in an amount of 0.5% by weight to 20% by weight inclusive and any of Ni, Co and Fe, if contained, is contained in an amount of 0.5% by weight to 40% by weight inclusive on an element basis, wherein the electrode tip contains residual oxygen in an amount of 70 ppm to 300 ppm inclusive.

2. A spark plug according to claim 1, wherein the electrode tip contains any element of Ti, Zr, Hf, and rare earth elements in an amount of 0.05% by weight to 0.5% by weight inclusive.

3. A spark plug according to claim 1, wherein the electrode tip contains an element other than Pd, Ir, Ni, Co, Fe, Ti, Zr, Hf, and rare earth elements in an amount of 0% by weight to 0.2% by weight inclusive.

4. A spark plug according to claim 1, wherein the electrode is made of Ni, or an alloy which contains Ni as a main component, and contains Si in an amount of 3% by weight or less.

5. A spark plug having an electrode tip at an end portion of an electrode, the electrode tip containing Pd as a main component in an amount greater than 40% by weight and containing at least one element selected from the group consisting of Ir, Ni, Co and Fe such that Ir, if contained, is contained in an amount of 0.5% by weight to 20% by weight inclusive and any of Ni, Co and Fe, if contained, is contained in an amount of 0.5% by weight to 40% by weight inclusive on an element basis, wherein the electrode tip contains residual oxygen in an amount of 0 ppm to 300 ppm inclusive, and wherein the electrode tip contains one or more of B, Na, Al, Si and Ba in a total amount of from 0.01 wt % to 0.25 wt % on an element basis.

6. A spark plug according to claim 5, wherein the electrode tip contains one or more of B, Na, Al, Si and Ba in a total amount of from 0.01 wt % to 0.2 wt % on an element basis.

* * * * *